US006158669A

United States Patent [19]

Louis

[11] Patent Number: 6,158,669

[45] Date of Patent: Dec. 12, 2000

[54] PORTABLE MISTING DEVICE

[76] Inventor: R. J. Louis, 5475 Round Meadow Rd., Hidden Hills, Calif. 91302

[21] Appl. No.: 09/378,135

[22] Filed: Aug. 19, 1999

[51] Int. Cl.[7] ..... B05B 9/03

[52] U.S. Cl. ..... 239/146; 239/289; 239/332

[58] Field of Search ..... 239/289, 128, 239/146, 332, 373; 4/615

[56] References Cited

U.S. PATENT DOCUMENTS

| | | | |
|---|---|---|---|
| 4,765,542 | 8/1988 | Carlson | 239/289 |
| 4,854,502 | 8/1989 | Cox | 239/289 X |
| 5,000,384 | 3/1991 | Arnold | 239/289 X |
| 5,111,538 | 5/1992 | Chapman | 4/615 X |
| 5,330,104 | 7/1994 | Marcus | 239/266 |
| 5,390,852 | 2/1995 | Schuenemann et al. | 239/332 X |
| 5,775,590 | 7/1998 | Utter | 4/615 X |

*Primary Examiner*—Lesley D. Morris
*Attorney, Agent, or Firm*—Blakely Sokoloff Taylor & Zafman LLP

[57] ABSTRACT

In one embodiment the present invention provides a portable misting device. The portable misting device has a housing including a fluid compartment to store a fluid to be misted. The housing further includes a fluid dispensing orifice to dispense the fluid outside the housing. The housing further includes a pressure providing device that communicates with the fluid compartment to cause the fluid to flow to the fluid dispensing orifice. The portable misting device also includes a handle, mounted to the housing, to carry the housing.

19 Claims, 9 Drawing Sheets

PORTABLE MISTING DEVICE

BACKGROUND OF THE INVENTION

I. Field of the Invention

The present invention relates to misting devices. Particularly, the present invention relates to self-contained misting devices.

II. Background Information

Misting devices have been used for years in connection with different applications. One application of misting devices is cooling off or refreshing individuals (users) in areas where other ways of cooling are not available. Typically, in a misting device a fluid such as water is fed to one or more nozzles that spray the water in a mist in a direction where a user may stand, sit, or lay.

One problem with these misting devices is that they are not self-contained. The water is typically fed to the misting device from a reservoir located remotely from the misting device and/or the misting device is not transportable, i.e.—is fixed at a given location. This limits the mobility of misting devices, and implicitly of users who are prevented from freely moving outdoors yet still being refreshed by the mist produced by the misting devices.

It is desirable to provide a misting device that is self-contained and easily transportable from one place to another at distances where the use of a power cord and/or a feedline for feeding water to the misting device would be cumbersome if not impossible.

SUMMARY OF THE INVENTION

In one embodiment the present invention provides a portable misting device. The portable misting device has a housing including a fluid compartment to store a fluid to be misted. The housing further includes a fluid dispensing orifice to dispense the fluid outside the housing. The housing further includes a pressure providing device that communicates with the fluid compartment to cause the fluid to flow to the fluid dispensing orifice. The portable misting device also includes a handle, mounted to the housing, to carry the housing.

BRIEF DESCRIPTION OF THE DRAWINGS

The features, aspects, and advantages of the present invention will become more fully apparent from the following Detailed Description, appended claims, and accompanying drawings in which:

DETAILED DESCRIPTION OF THE INVENTION

In the following description, numerous specific details are set forth to provide a thorough understanding of the present invention. However, one having ordinary skill in the art should recognize that the invention may be practiced without these specific details. In some instances, well-known circuits, structures, and techniques have not been shown in detail to avoid obscuring the present invention.

Figure 1:
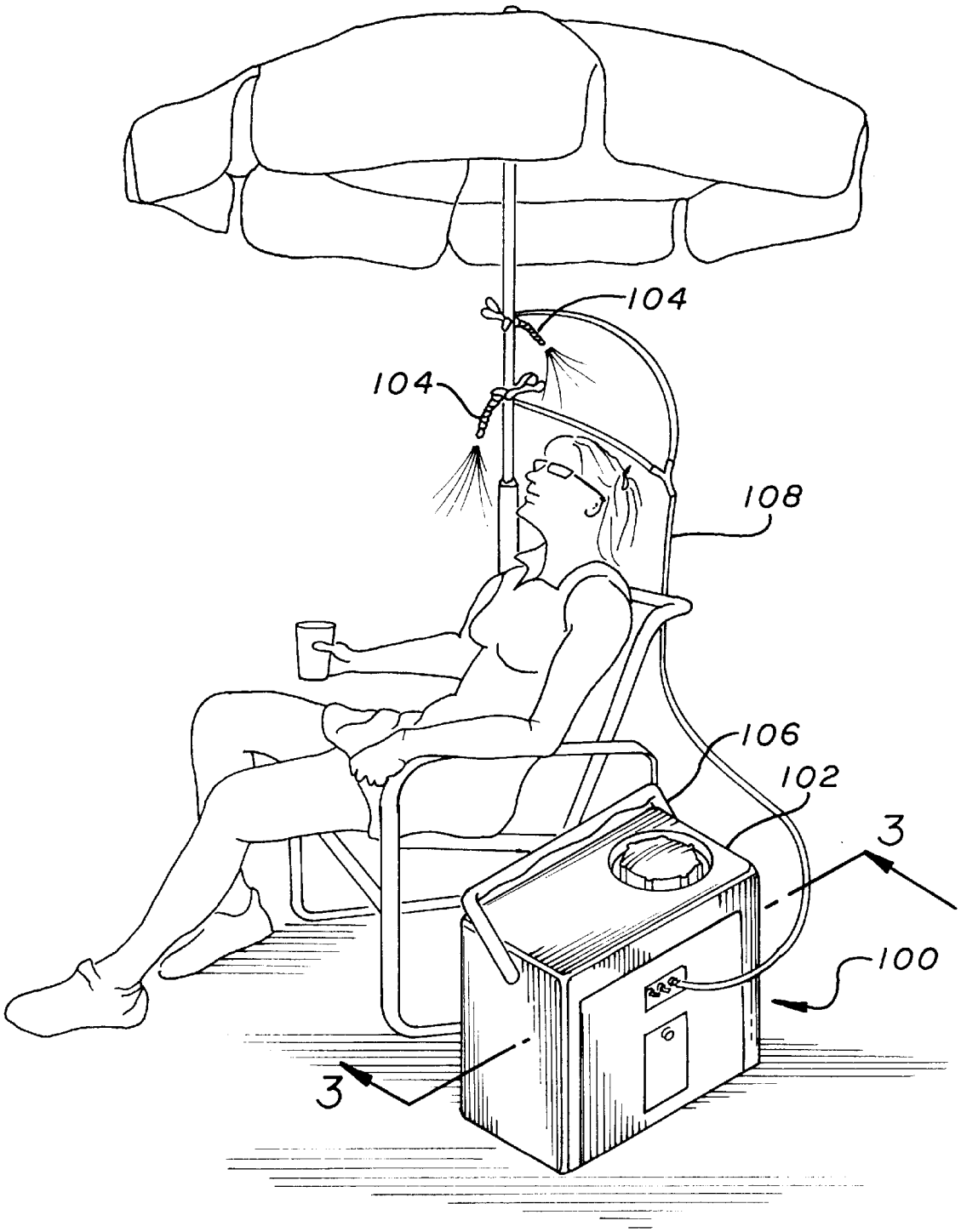
FIG. 1 illustrates a perspective view of a misting device according to one embodiment of the present invention.

FIG. 1 illustrates a perspective view of a misting device 100 according to one embodiment of the present invention. Misting device 100 is portable, self-contained, and easily transportable. Misting device 100 includes a housing 102 to which a handle 106 is attached. Misting device 100 has a reasonable weight and may be easily carried by holding handle 106. Misting device 100 has a multiplicity of uses: it may be used by tennis players while taking a break, it may be used at the beach or by a swimming pool, or it may be used by golf players, etc.

Misting device 100 may spray water or other fluids in a mist form via nozzle 104. Water is typically fed to nozzle 104 via a conduit 108, which may be flexible. The water is stored in a self-contained fluid compartment (not shown) that communicates with conduit 108. A pressure providing device such as a pump (not shown) drives the water upwardly via conduit 108 causing water to flow to nozzles 104 and therefore be outwardly dispensed.

Figure 2:
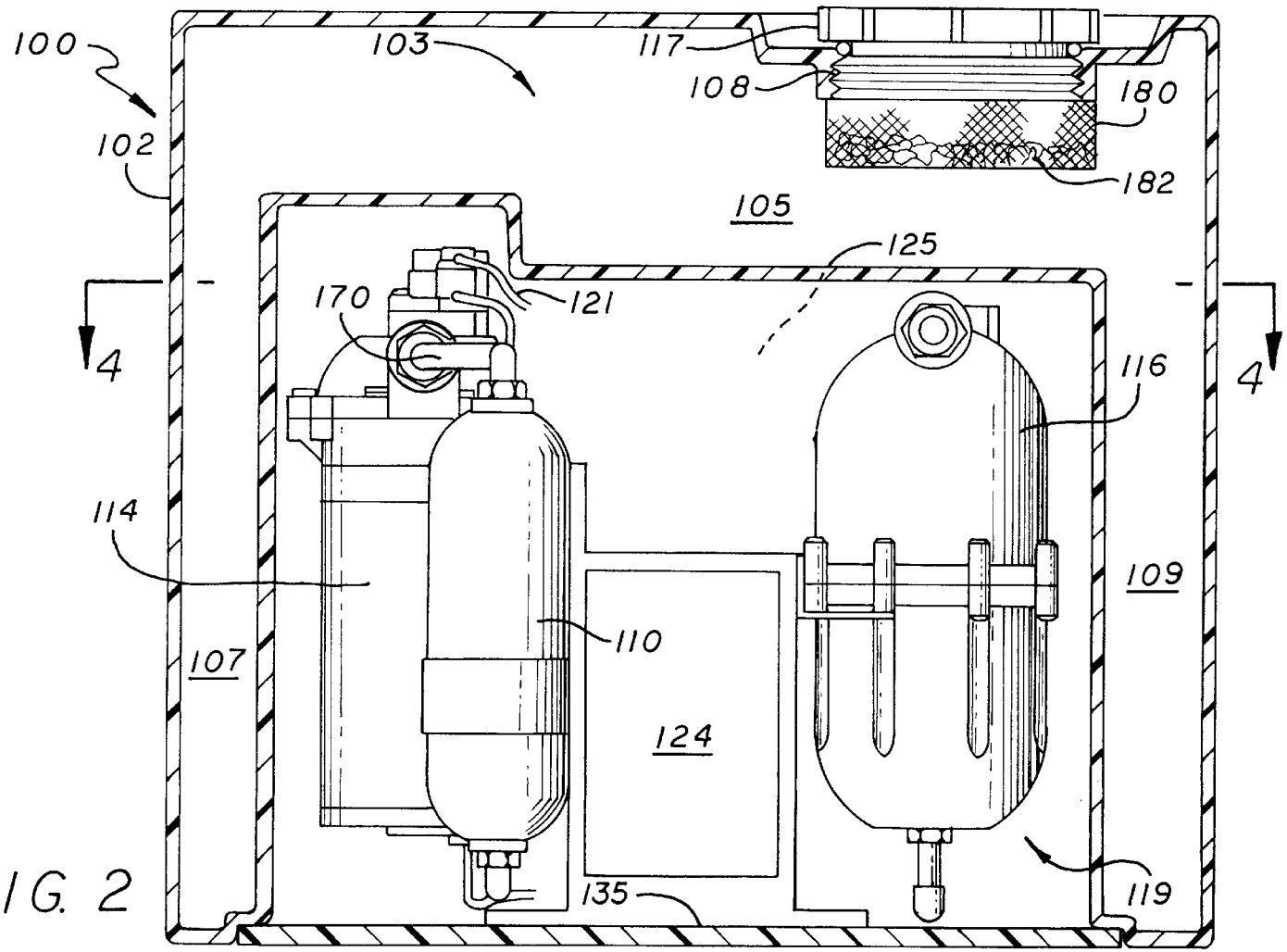
FIG. 2 illustrates a cross-sectional view of misting device taken along line 3 of FIG. 1.

FIG. 2 illustrates a cross-sectional view of misting device 100 taken along line 3 of FIG. 1. Misting device 100 includes a housing unit 102. In one embodiment of the present invention housing unit 102 is made of plastic by way of injection molding. Housing unit 102 includes a fluid compartment 103 that is filled with a fluid to be dispensed in the form of mist. In one embodiment according to the present invention the fluid to be misted is water. The fluid compartment 103 has four regions: top region 105, side regions 107 and 109 and a back region 125. Water may be inserted in the fluid compartment 103 through the fill well 108. A protective cap 117 is threaded into the threaded walls of the fill well 108. Optionally, a screen 180 may be mounted to the walls of the full well 108. The screen 180, which has the shape of a cup, may hold ice in the form of ice cubes 182 to cool down the fluid in fluid compartment 103.

The housing unit 102 further includes a compartment 119 that is surrounded by regions 107, 109, 105, 125 and by a bottom panel 135. Compartment 119 houses mechanical and electro-mechanical units such as filter 110, accumulator 116, and pressure providing device 114 (hereinafter referred to as "pump"). Accumulator 116 is a conventional accumulator and serves as a pressure storage device storing the water at a given pressure. The structure and functions of accumulator 116 are well-known in the art of plumbing. Accumulator 116 includes a bladder which is filled up with water that is compressed by an air chamber. Accumulator 116 may be implemented by way of an accumulator from Shur-Flo of Garden Grove, Calif. The toggle valve 118 has an opening by way of which water may be sent out via conduit 108 to the nozzles 104 (not shown). The toggle valve also has a switch 131 which when turned off prevents the flow of water from accumulator 116 via conduit 108 to nozzles 104.

Compartment 119 further stores a filter 110 that provides filtering of the water to avoid clogging of the nozzles 104 (not shown in this figure). Filter 110 filters the water before the water is fed to the pump 114. Alternatively, filter 110 may be placed after the pump 114. Pump 114 is a motorized pump operated by a motor. This pump may be made available by Shur-Flo, of Garden Grove, Calif. The motorized pump 114 is powered by a 12 volt battery (not shown) that is stored into battery housing 124 of the mounting bracket 123. Pump 114 is coupled via several wire conductors 121 to the battery that communicates with Filter 110 by way of hose 170. The filter 110, the pressure providing device 114, and the accumulator 116 are attached (affixed) to mounting bracket 123. Mounting bracket 123 is mounted to the bottom panel 135.

Figure 3:
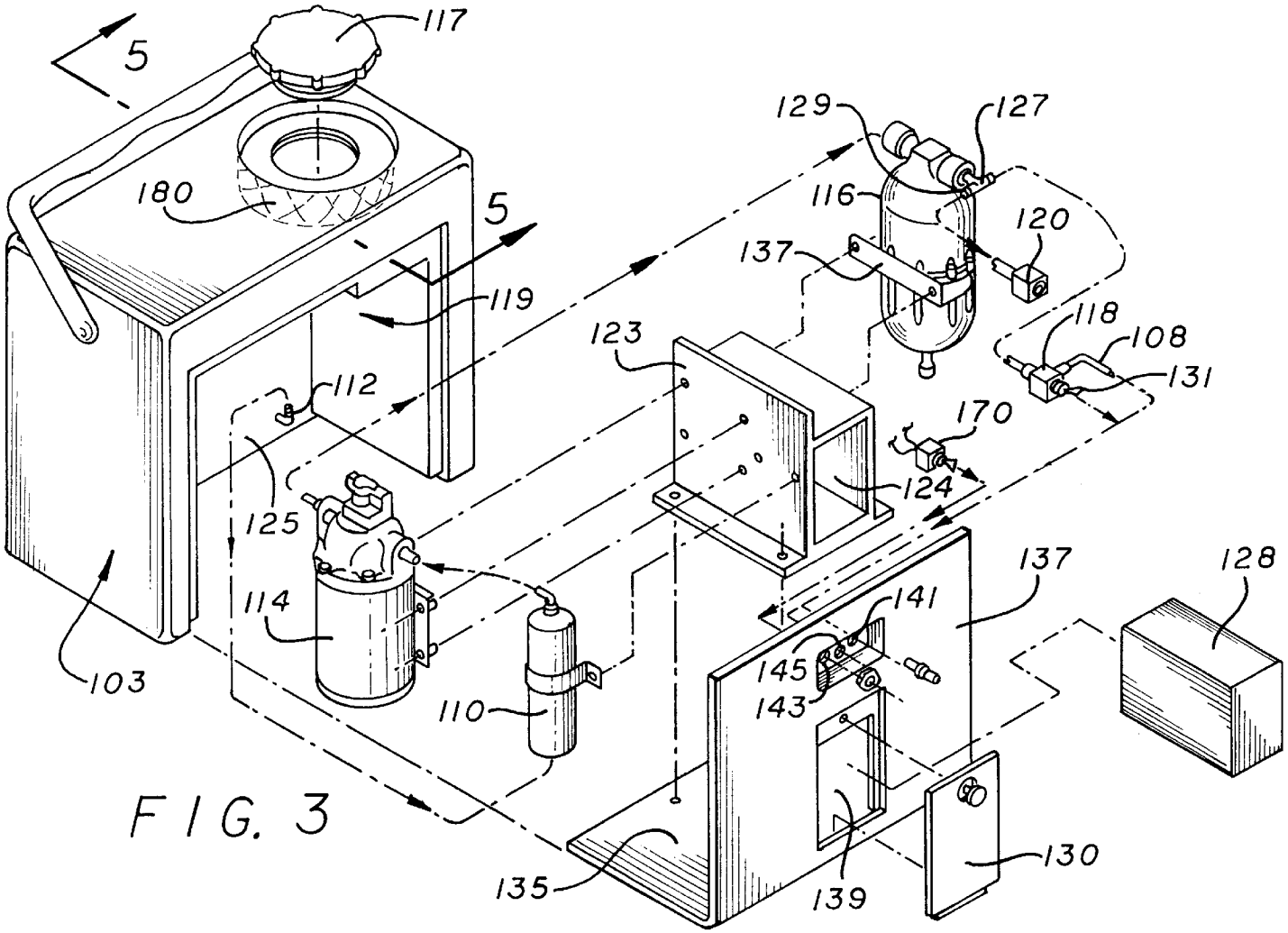
FIG. 3 illustrates an exploded view of housing unit and of the electro-mechanical structures located in compartment of housing unit.

FIG. 3 illustrates an exploded view of housing unit 102 and of the electro-mechanical structures located in compartment 119 of housing unit 102. The back region 125 of fluid compartment 103 has a nipple 112 through which water may be provided to filter 110. Water from the housing unit 103, therefore, flows via nipple 112 to the bottom of filter 110 as indicated by the phantom lines with arrows that show the direction of the flow of water. The filtered water then flows from filter 110 to the pump 114. Pump 114 provides the necessary pressure for the water to further flow to the nozzles (not shown in this figure). Water at a specified pressure then flows from pump 114 to the accumulator 116 that maintains the specified pressure. The accumulator 116 has terminations 127 and 129 that communicate with a toggle valve 118 and to a pressure relief valve 120, respectively.

FIG. 3 further illustrates tray 135 and sidewall 137 that in one embodiment may be integral with tray 135. In one embodiment of the present invention, mounting bracket 123 may be affixed to tray 135 by way of screwing. The filter 110 and the pump 114 may be laterally mounted to the mounting bracket 123 as shown in the figure. The accumulator may be mounted by way of bracket 137 to an outer side of the battery housing 124. When the battery housing 124 and the mounting bracket 123 are affixed to tray 135, battery 128 may be inserted into the battery housing 124 through a battery opening 139. After the battery is inserted into the battery housing, door 130 is deliberately mounted into sidewall 137 to cover the battery opening 139.

The sidewall 137 has a plurality of orifices formed therethrough. The right hand side orifice 141 is used to pass through hose 108. The middle orifice 145 is used for the switch 131. An electrical switch 170, coupled to the battery switches the power on or off and communicates with the outside world by way of left hand orifice 143.

Figure 4:
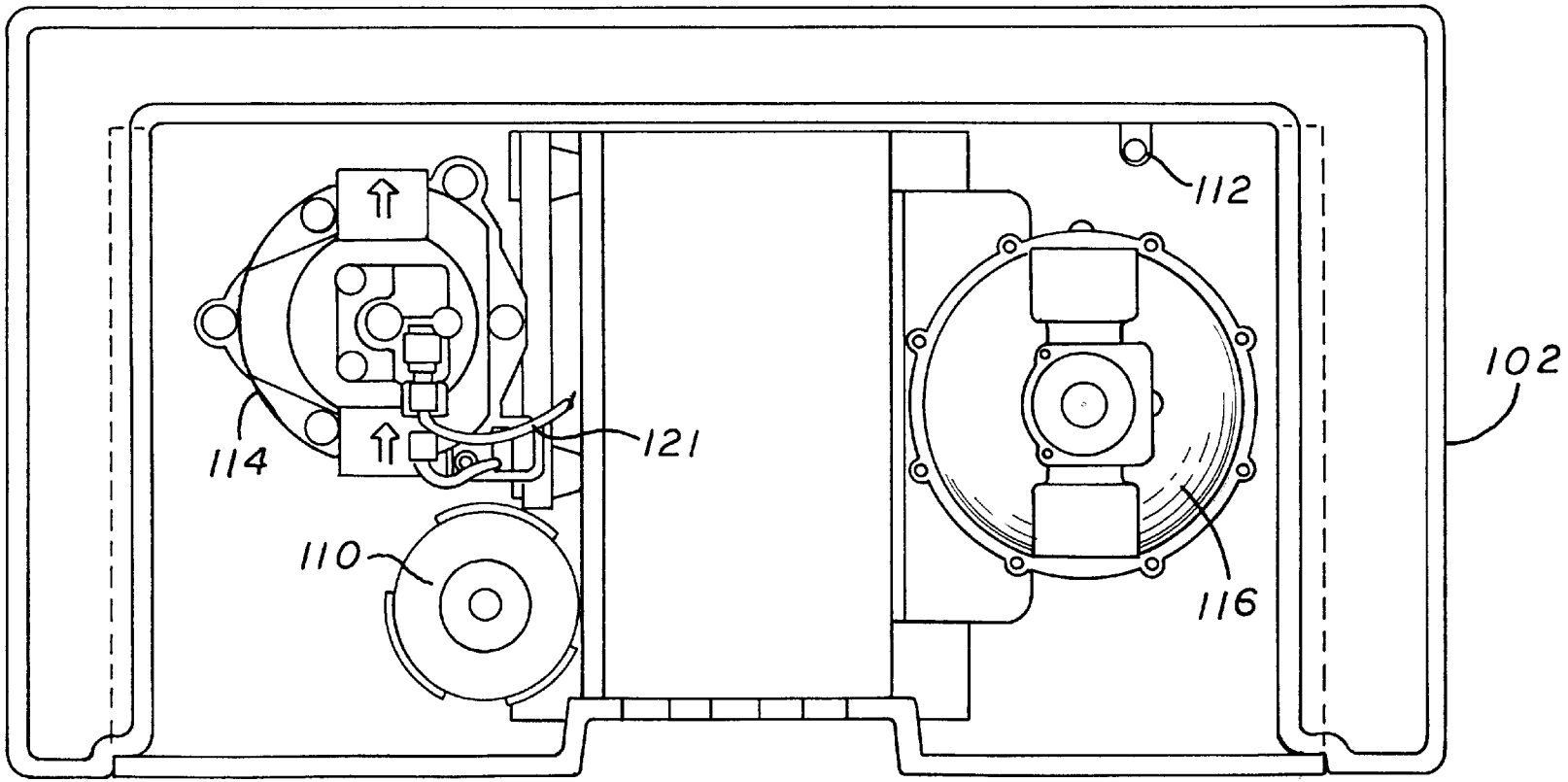
FIG. 4 is a cross-sectional view through line 4—4 of FIG. 2.

FIG. 4 is a cross-sectional view through line 4—4 of FIG. 2. This fixture shows housing unit 102 with the accumulator 116, the pump 114 and, filter 110.

Figure 5:
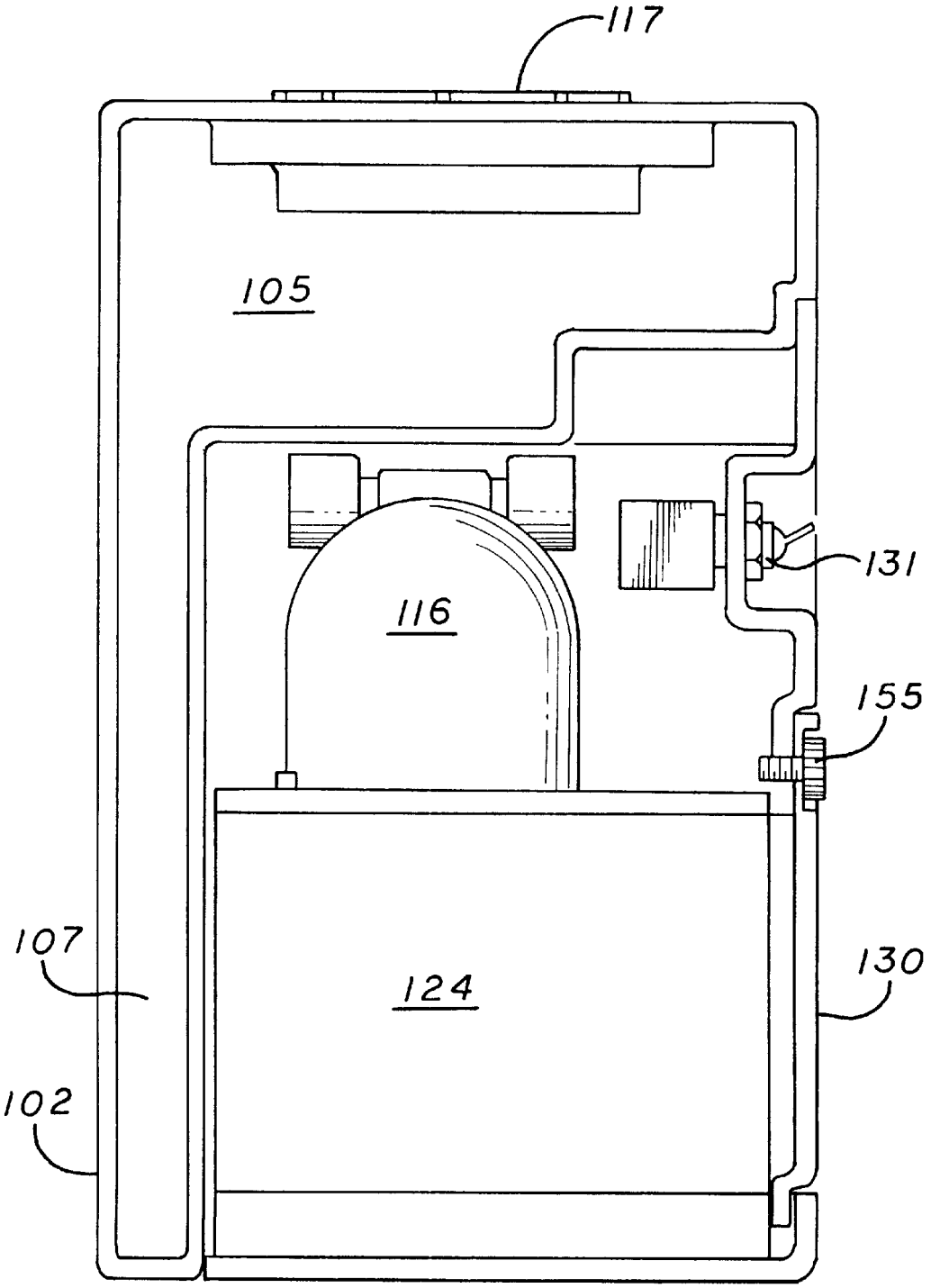
FIG. 5 illustrates a cross-sectional view through line 5—5 of FIG. 2.

FIG. 5 illustrates a cross-sectional view through line 5—5 of FIG. 2. The housing unit 102 is shown with the upper portion of the fluid container 105 and one of the lateral portions 107 of the fluid container. The cap 117 prevents the water from spilling out. A portion of the accumulator 116 may be seen in this figure. The electric switch 131 turns the power on or off. The screw 155 attaches the door 130 to the housing unit preventing the battery housing 124 from sliding out of the battery housing 124.

Figure 6:
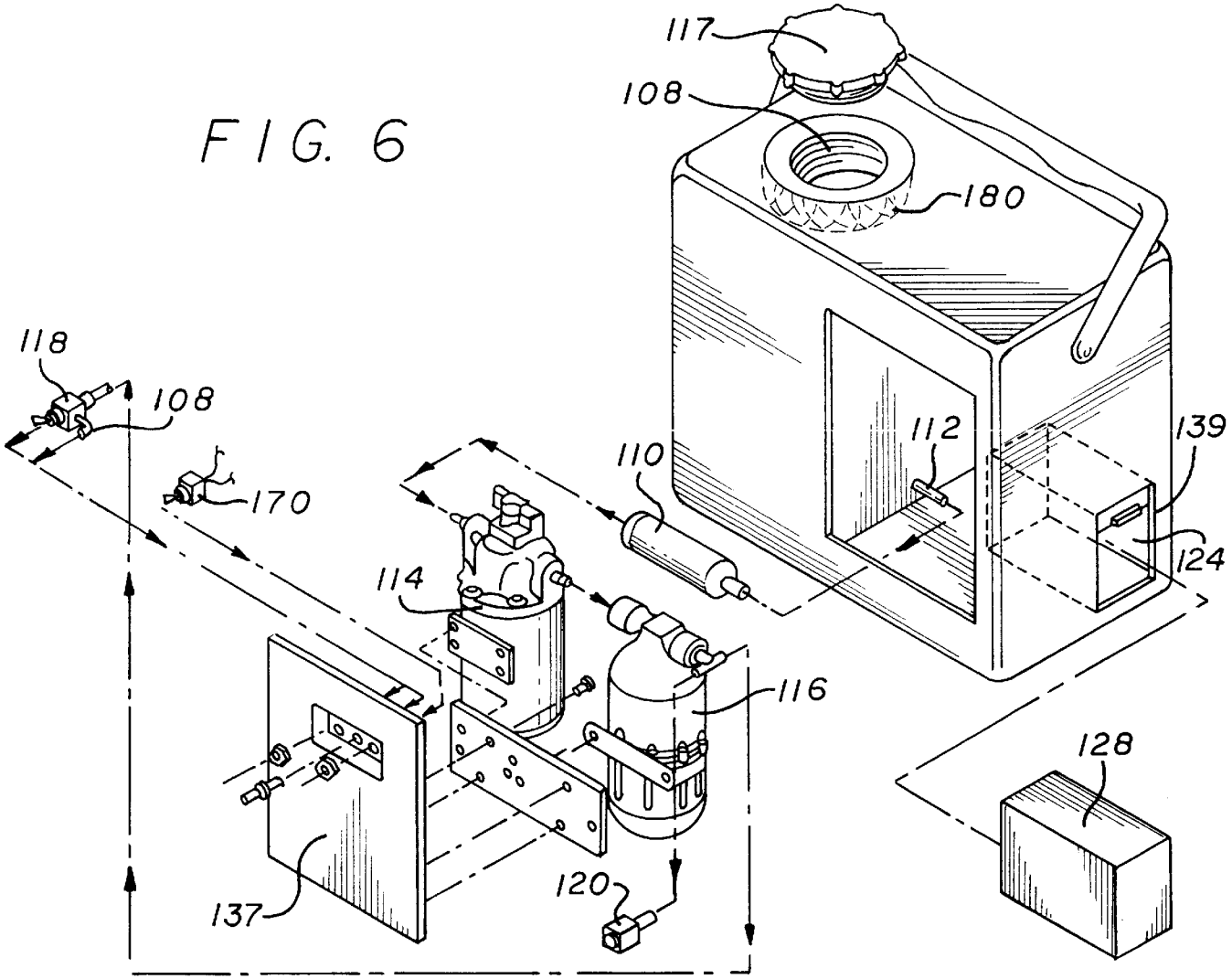
FIG. 6 illustrates an exploded view of an alternative embodiment of the portable misting device of FIG. 3.

FIG. 6 illustrates an exploded view of an alternative embodiment of the portable misting device of FIG. 3. The alternative embodiment includes all the parts of the embodiment of FIG. 3 with the exception that the electro-mechanical devices that are placed in the compartment 119 of FIG. 3 are now placed on the side in the compartment 119 shown at the right most part of the housing 102. In this case, the fluid compartment 103 is placed at the left side of the housing 102.

Figure 7:
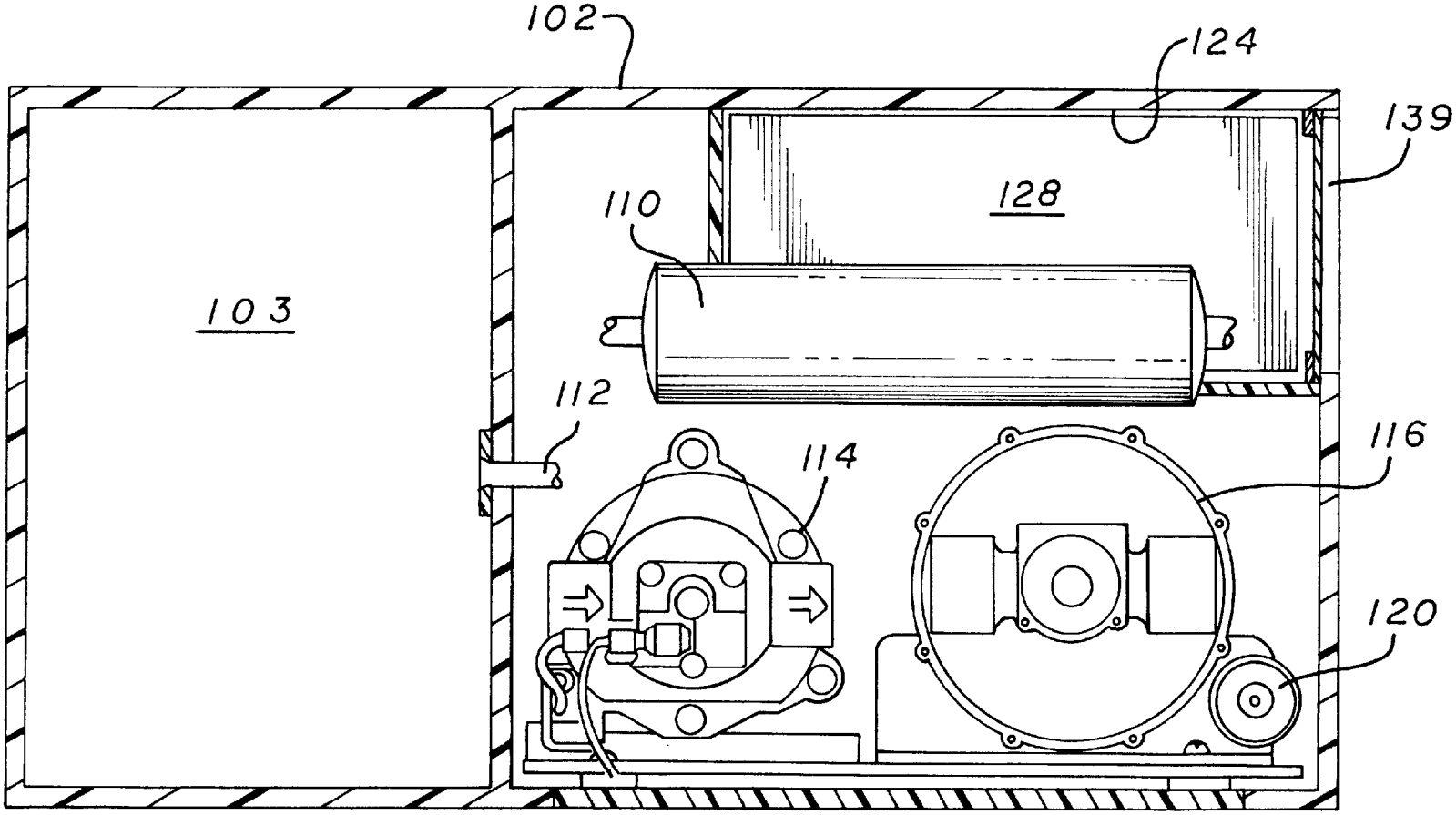
FIG. 7 is a cross sectional view through line 55 of FIG. 6.

FIG. 7 is a cross sectional view through line 55 of FIG. 6. As one may see the electro mechanical parts are all placed at the right side of housing 102.

Figure 8:
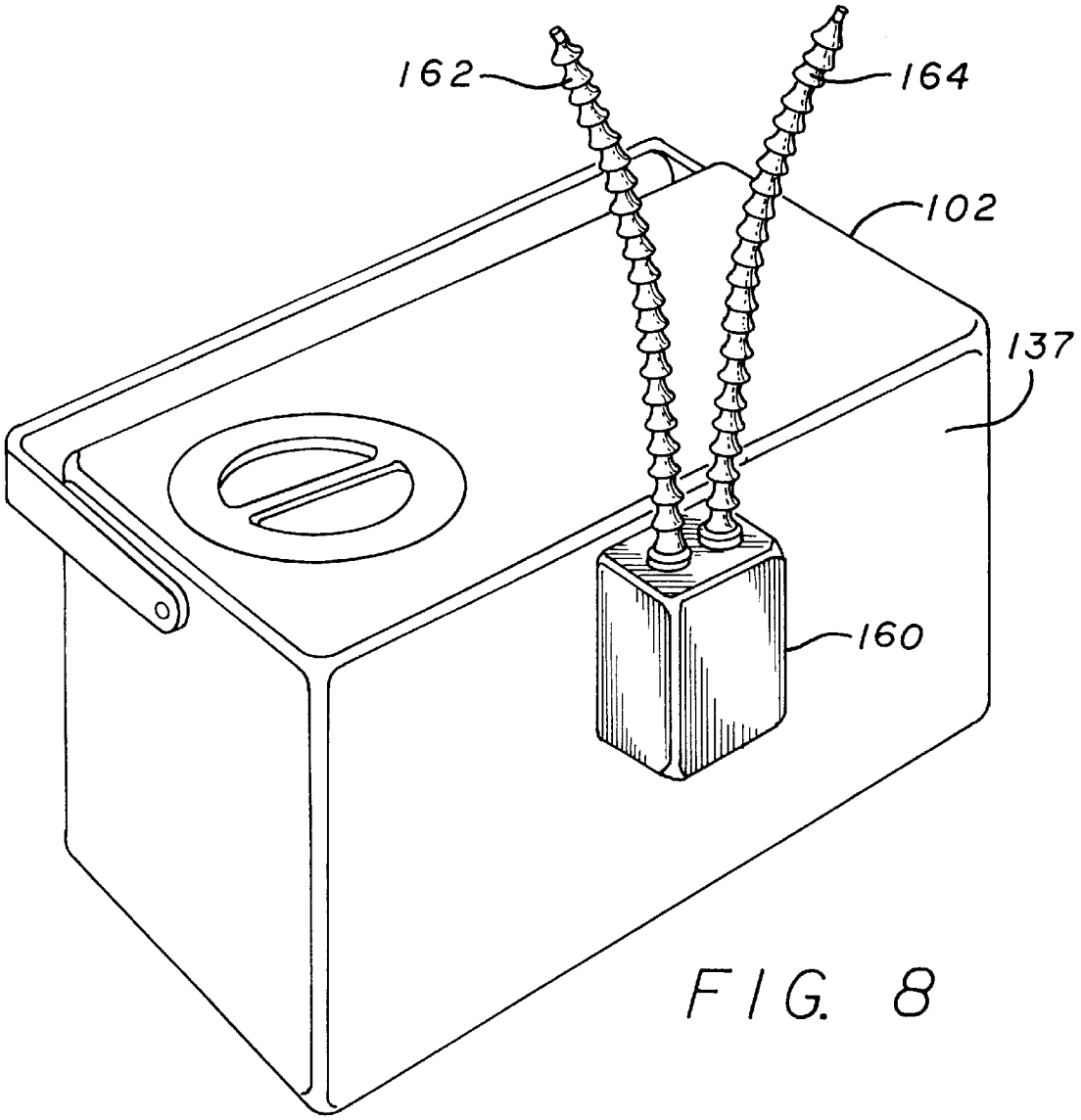
FIG. 8 illustrates the portable misting device with an adapter attached to side panel of housing.

FIG. 8 illustrates the portable misting device with an adapter 160 attached to side panel 137 of housing 102. The adapter 160 has two nozzles, 162 and 164. This adapter may be useful when the misting device is used for providing mist in two different directions where users of the misting device may be located.

Figure 9:
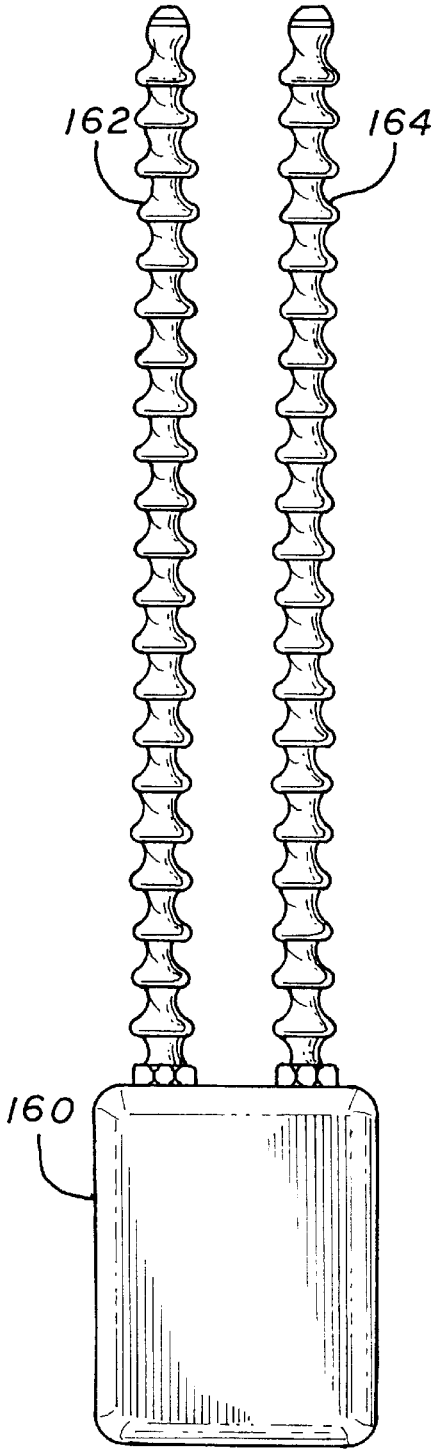
FIG. 9 illustrates a view of the adapter shown separate from the misting device.

FIG. 9 illustrates a view of the adapter 160 shown separate from the misting device.

Figure 10:
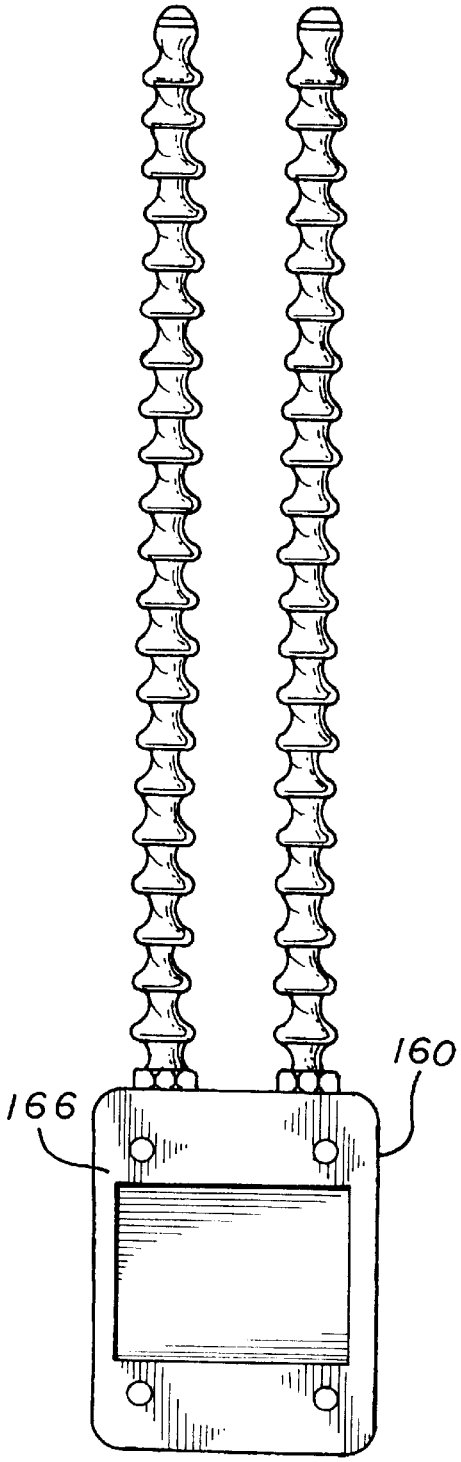
FIG. 10 illustrates a view of the adapter that is mounted to panel of the misting device.

FIG. 10 illustrates a view of the adapter 166 that is mounted to panel 137 of the misting device.

In the previous detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. A portable misting device comprising:

a housing including:

a fluid compartment, to store a fluid to be misted;

a fluid dispensing orifice to dispense the fluid outside the housing;

a pressure providing device, communicating with the fluid compartment, to cause the fluid to flow to the fluid dispensing orifice;

an accumulator communicating with the pressure providing device and the fluid dispensing orifice; and a valve disposed between the accumulator and the fluid dispensing orifice;

a handle, mounted to the housing, to carry the housing.

2. The portable misting device of claim 1 wherein said base housing includes a compartment where said pressure providing device is placed.

3. The portable misting device of claim 1 wherein said pressure providing device includes a pump.

4. The portable misting device of claim 1 wherein said housing further includes a battery coupled to said pump.

5. The portable misting device of claim 4 further including a switch coupled to the battery to switch into one of an ON and OFF position.

6. The portable misting device of claim 1 further including a nozzle adapter, mounted to the housing, the nozzle adapter having at least one nozzle in communication with said fluid dispensing orifice.

7. The portable misting device of claim 6 wherein the nozzle adapter has at least two nozzles.

8. The portable misting device of claim 1 further including a screen, mounted onto the fluid compartment, to hold ice to cool down the fluid to be misted.

9. The portable misting device of claim 1 wherein said fluid includes water.

10. A portable misting device comprising:

housing including a fluid compartment, to store a fluid to be misted, and a fluid dispensing orifice to dispense the fluid outside the housing, said housing further including a pressure providing device, communicating with said fluid compartment, to cause said fluid to flow to said fluid dispensing orifice, the fluid compartment further having a screen mounted therein, the screen having a cup-like shape to hold ice; and a handle, mounted to said housing, to carry said housing.

11. The portable misting device of claim 10 wherein said base housing includes a compartment where said pressure providing device is placed.

12. The portable misting device of claim 10 wherein said pressure providing device includes a pump.

13. The portable misting device of claim 10 wherein said housing further includes a battery coupled to said pump.

14. The portable misting device of claim 13 further including a switch coupled to the battery to switch into one of an ON and OFF position.

15. The portable misting device of claim 13 wherein said housing further includes an accumulator communicating with said pump, said accumulator storing fluid at a predetermined pressure.

16. The portable misting device of claim 10 further including a nozzle adapter, mounted to the housing, the nozzle adapter having at least one nozzle in communication with said fluid dispensing orifice.

17. The portable misting device of claim 16 wherein the nozzle adapter has at least two nozzles.

18. The portable misting device of claim 10 further including a screen, mounted onto the fluid compartment, to hold ice to cool down the fluid to be misted.

19. The portable misting device of claim 10 wherein said fluid includes water.

* * * * *